US005308223A

United States Patent [19]

Sternheimer et al.

[11] Patent Number: 5,308,223

[45] Date of Patent: May 3, 1994

[54] PACKAGE HANDLING SYSTEM

[75] Inventors: Arthur Sternheimer, Spring Valley, N.Y.; Anthony Marchiano, E. Stroudsburg, Pa.; Donald Johnson, Matawan, N.J.

[73] Assignee: Block Drug Company Inc., Jersey City, N.J.

[21] Appl. No.: 751,999

[22] Filed: Aug. 29, 1991

[51] Int. Cl.[5] ..... B65G 57/00

[52] U.S. Cl. ..... 414/790.3; 414/790.6; 414/790.8; 414/790.9; 414/794.4

[58] Field of Search ..... 271/189; 414/790.3, 414/790.5, 790.6, 790.8, 790.9, 792.7, 794.4

[56] References Cited

U.S. PATENT DOCUMENTS

| | | | |
|---|---|---|---|
| 2,414,059 | 1/1947 | Powers | 271/189 X |
| 3,379,320 | 4/1968 | Loach et al. | 414/790.3 X |
| 3,745,740 | 7/1973 | Williams | 414/790.3 X |
| 4,934,687 | 6/1990 | Hayden et al. | 271/189 X |

*Primary Examiner*—D. Glenn Dayoan
*Assistant Examiner*—Boris Milef
*Attorney, Agent, or Firm*—Ostrolenk, Faber, Gerb & Soffen

[57] ABSTRACT

Disclosed is an automated system which collates (i.e. counts and assembles packages into stacks) and positions the stacks on a cartoner conveyor. The system includes an abort plate movable between a first position and a second position for supporting a stack of packages when in the first position and permitting packages to fall past the first position when in the second position; a pusher plate movable between a first package supporting position and a second position permitting packages to fall onto the abort plate when the abort plate is in the first position and further adapted to push the stack off the abort plate when the pusher plate is moved from the second to first position; and a gate movable between a first package separating position and a second position for permitting the packages to fall onto the pusher plate.

7 Claims, 8 Drawing Sheets

PACKAGE HANDLING SYSTEM

BACKGROUND OF THE INVENTION

1. Field of the Invention

The present invention relates to a system for handling packages. In particular, the present invention relates to an automated system for collating or assembling packages into stacks and for positioning the stacks on a conveyor.

2. Description of the Related Art

A known package forming and handling system 10 is illustrated in FIGS. 1 and 2. The system 10 includes a tablet press (not illustrated) for forming tablets 12 and a packaging system 14 for sealing the tablets 12 within packages 15.

The packaging system 14 drops the packages 15 onto a conveyor 16. The conveyor 16 is normally operated at low speed. But when a predetermined number of packages 15 have fallen onto the conveyor 16, the conveyor 16 is operated at a relatively high speed for a predetermined, short period of time. This produces separate, "shingled" stacks 18.

At the end of the conveyor 16, the packages 15 are scooped up by human loaders 20, counted and manually loaded onto a cartoner conveyor 22.

The system 10 is generally not sufficiently efficient, reliable and accurate. For example, the conveyor 16 may not maintain the packages within the stacks 18 as desired. As the stacks 18 are conveyed toward the cartoner conveyor 22, the stacks 18 tend to become disoriented and the packages 15 tend to commingle with each other. This makes it difficult to accurately and quickly load the packages 15 onto the cartoner conveyor 22.

Moreover, new systems have been developed for forming and packaging the tablets 12. These new systems are capable of producing packages 15 at a very high speed. The intermittent shingling conveyor 16 is too slow to be used with the new systems.

SUMMARY OF THE INVENTION

Accordingly, an object of the present invention is to provide an automated system which is efficient and reliable and which operates at a high speed.

The present invention in accordance with one aspect thereof is directed to a package handling system which includes: an abort plate which is movable between a first position and a second position, the abort plate being adapted to support a stack of packages when the abort plate is in its first position, the abort plate being adapted to permit packages to fall past the first position when the abort plate is in its second position; a pusher plate which is movable between a first position and a second position, the pusher plate being adapted to support packages when the pusher plate is in its first position, the pusher plate being adapted to permit packages to fall onto the abort plate when the pusher plate is in its second position and the abort plate is in its first position, the pusher plate being adapted to push the stack of packages off the abort plate when the pusher plate is moved from its second position to its first position; and a gate which is movable between a first position and a second position, the gate being adapted to separate packages from the stack when the gate is in its first position, the gate being adapted to permit packages to fall onto the pusher plate when the gate is in its second position and the pusher plate is in its first position.

The present invention in accordance with another aspect thereof is directed to a system which includes: (A) a conveyor which includes: (1) an end; (2) lugs for pushing packages toward the end; and (3) means for moving the lugs toward the end, then around the end and then away from the end; and (B) a conveyance system for moving the packages from the conveyor and for increasing the speed of the packages so as to move the packages away from the lugs as the lugs are moved around the end of the conveyor.

The present invention in accordance with another aspect thereof is directed to a system which includes: a cartoner conveyor for conveying stacks, the cartonel conveyor including a plurality of locations for receiving stacks; a barrel loader for pushing stacks onto the locations of the cartoner conveyor; stack forming means for simultaneously forming a plurality of stacks; indexer pushers for simultaneously pushing the plurality of stacks onto the barrel loader; an indexing conveyor for simultaneously moving the plurality of stacks from the stack forming means to the indexer pushers; a pusher device for simultaneously pushing the plurality of stacks onto the indexing conveyor.

One embodiment of the present invention includes adapting the cartoner conveyor to comprise first and second locations for receiving stacks, each of the first locations being located between two of the second locations, each of the second locations being located between two of the first locations; a barrel loader for pushing stacks onto the first locations of the cartoner conveyor; and means for positioning stacks at the second locations of the cartoner conveyor, the means for positioning stacks at the second locations being separate from the barrel loader, the stack forming means, the indexer pushers, the indexing conveyor and the pusher device for positioning stacks at the first locations.

In another embodiment, the stack forming means is adapted to simultaneously form first, second, third, fourth and fifth stacks; the index pusher to simultaneously push the first, third and fifth stacks onto the barrel loader and then simultaneously push the second and fourth stacks onto the barrel loader.

The present invention in accordance with another aspect thereof is directed to a system which includes: a cartoner conveyor for conveying stacks, the cartoner conveyor including a plurality of locations for receiving stacks; a barrel loader for pushing stacks onto the cartoner conveyor; a stack forming means for simultaneously forming a plurality of stacks; pushing means for successively pushing the plurality of stacks from the stack forming means directly onto the barrel loader.

The aforementioned aspect of the present invention includes: adapting the cartoner conveyor to comprise first and second locations for receiving stacks, each of the first locations being located between two of the second locations, each of the second locations being located between two of the first locations; a barrel loader for pushing stacks onto the first locations of the cartoner conveyor; and means for positioning stacks at the second locations being separate from the barrel loader, the stack forming means and the pushing means for positioning stacks at the first locations.

Other features and advantages of the present invention will become apparent from the following detailed description of preferred embodiments of the invention, with reference to the accompanying drawings.

DETAILED DESCRIPTION OF THE PREFERRED EMBODIMENTS

Figure 1:
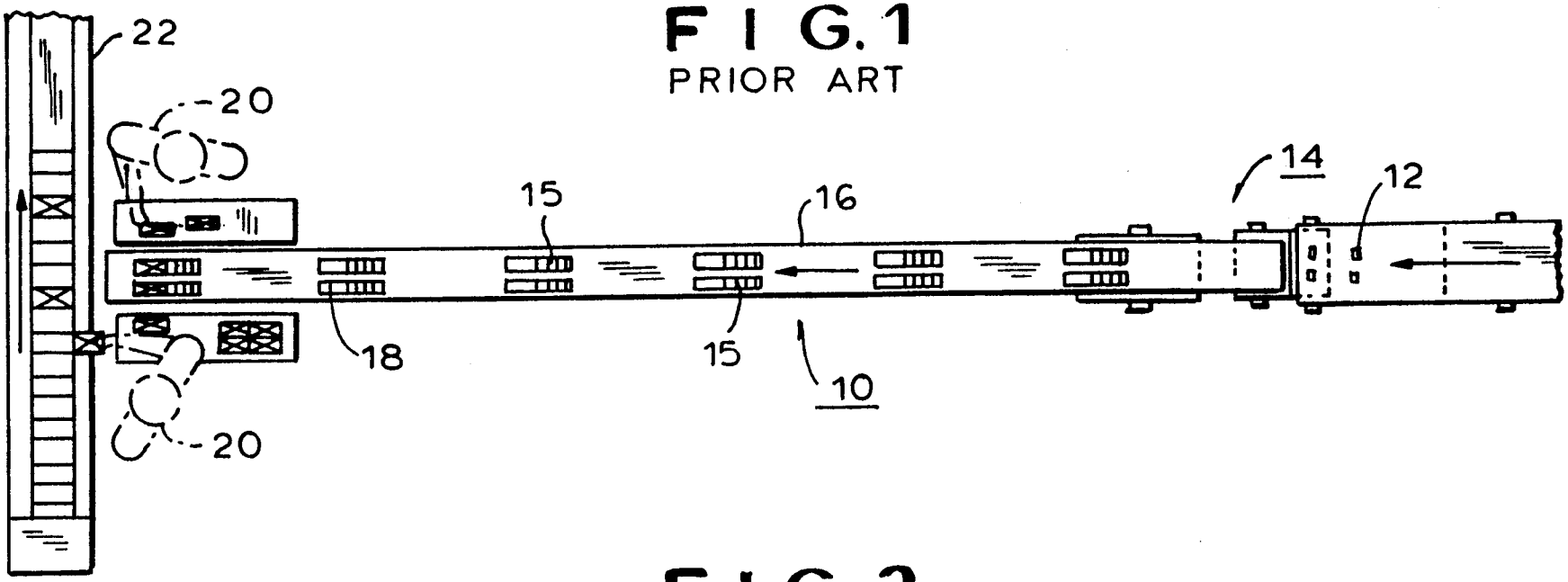
FIG. 1 PRIOR ART
FIG. 1 is a top view of a prior art package forming and handling system.
Figure 2:
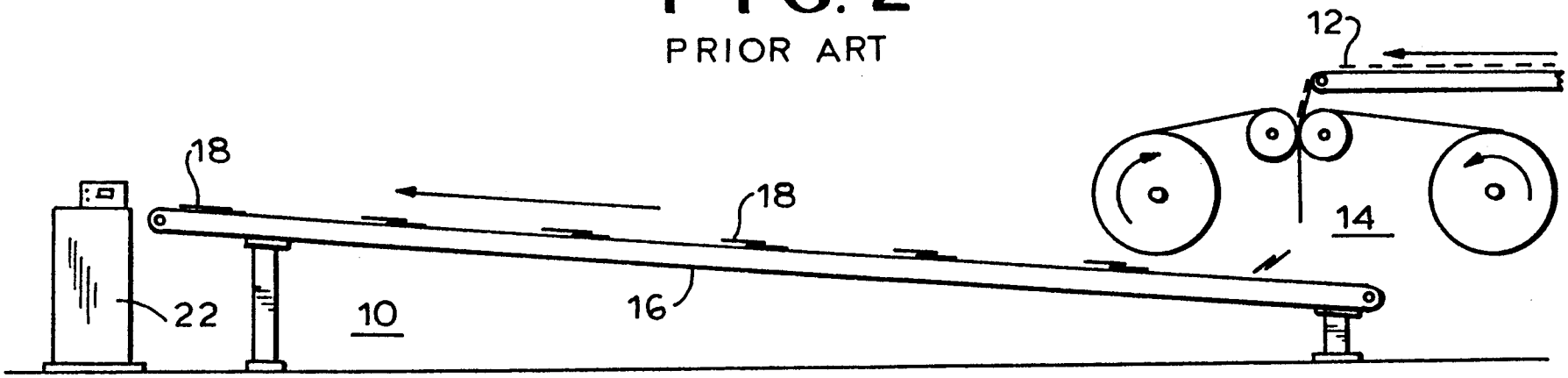
FIG. 2 PRIOR ART
FIG. 2 is a side view of the system of FIG. 1.
Figure 3:
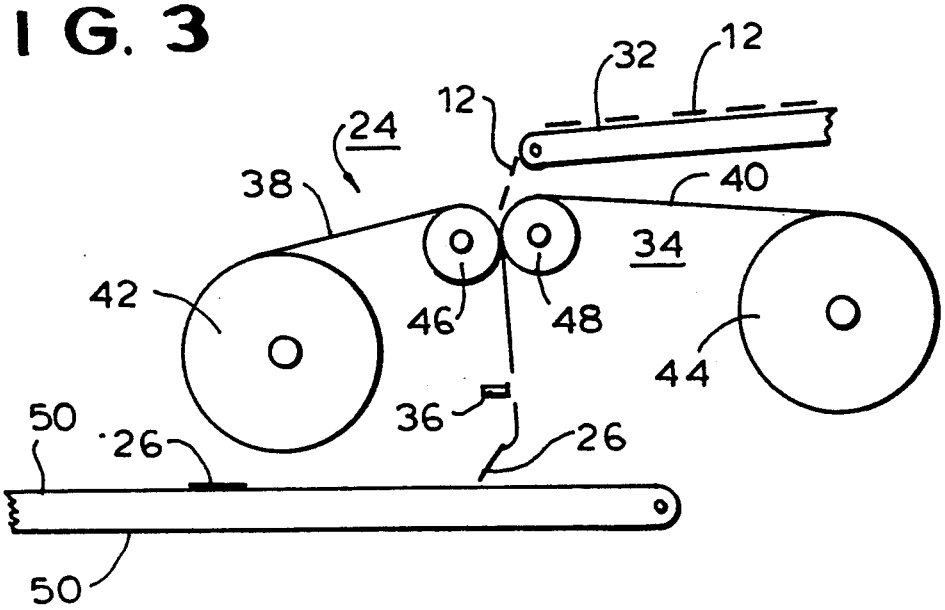
FIG. 3 is a schematic side view of a package forming system in accordance with the present invention.
Figure 4:
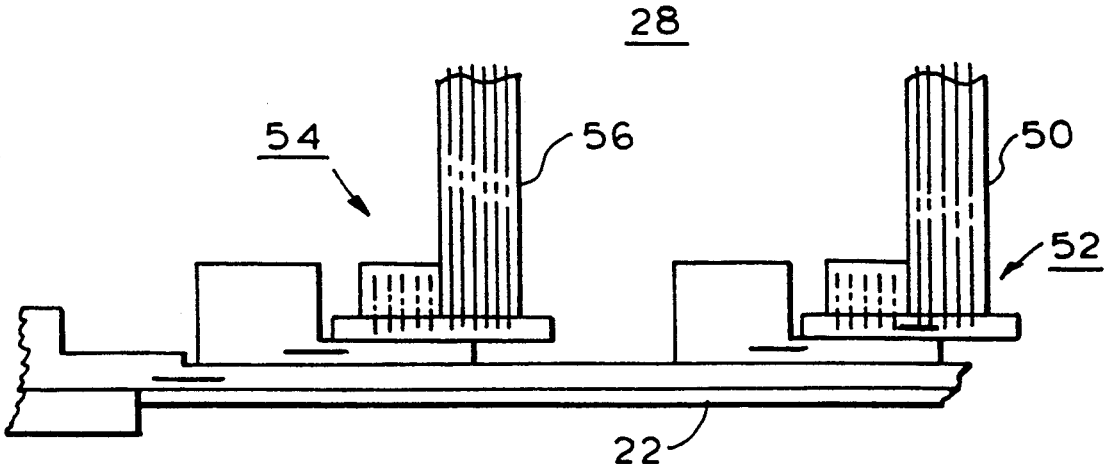
FIG. 4 is a schematic top view of a package handling system in accordance with the present invention.
Figure 5:
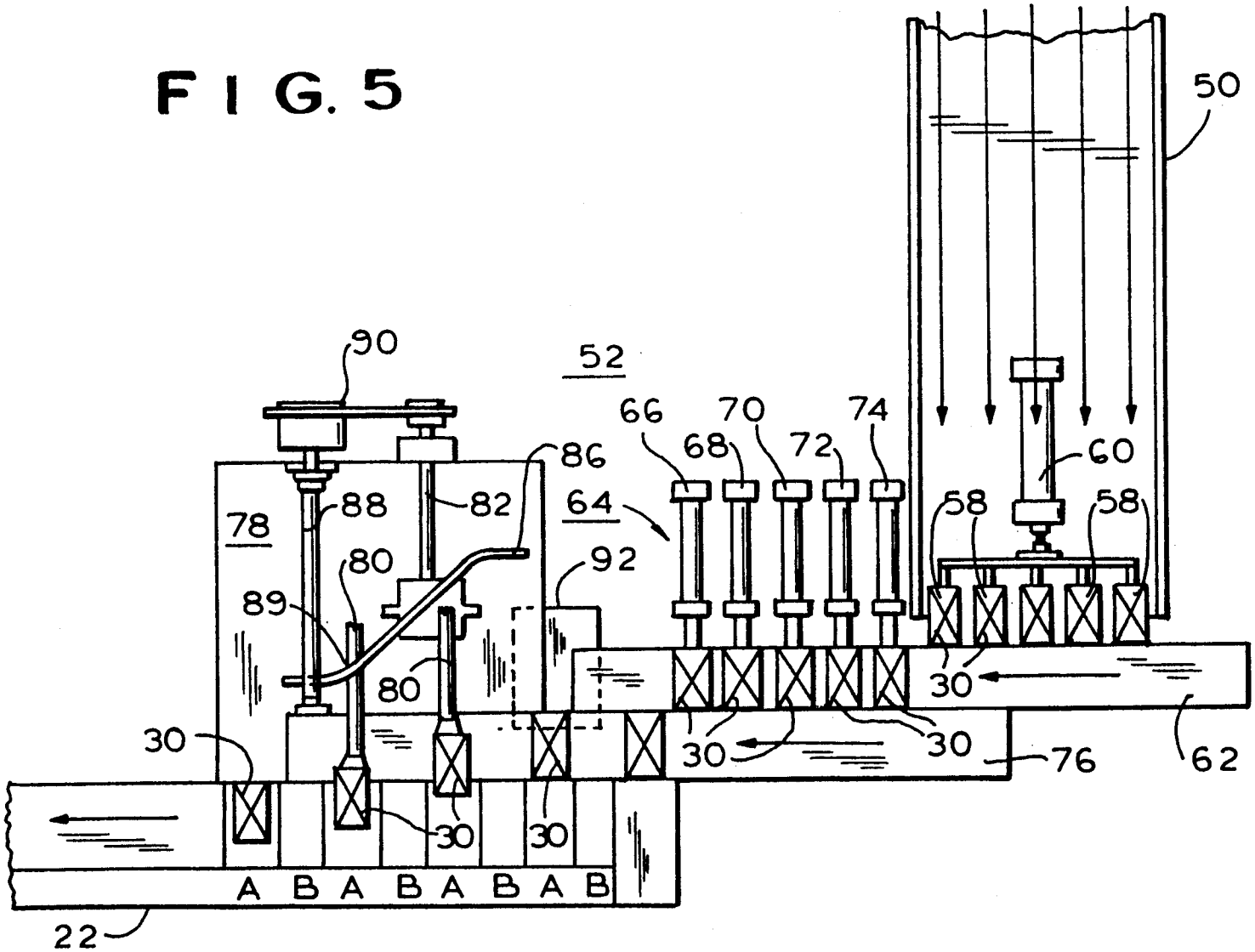
FIG. 5 is a detailed, partial top view of the package handling system of FIG. 4.

Referring now to the drawings, wherein like reference numerals indicate like elements, there is shown in FIGS. 3-5 a system which is constructed in accordance with the principles of the present invention. The system illustrated in FIGS. 3-5 includes a packaging system 24 (FIG. 3) for forming packages 26 and a handling system 28 (FIG. 4) for counting and assembling the packages 26 into stacks 30 (FIG. 5) and for positioning the stacks 30 on a cartoner conveyor 22, which is identical to the cartoner conveyor 22 illustrated in FIGS. 1 and 2.

The packaging system 24 illustrated in FIG. 3 is generally similar to the system 14 illustrated in FIG. 2, but operates much faster. The packaging system 24 includes a conveyor 32, a foiler 34 and a cutter 36. Tablets 12 are conveyed by the conveyor 32 from a tablet press (not illustrated) to the foiler 34. At the foiler 34, the tablets 12 are arranged into ten columns. The columns of tablets 12 are then directed between sheets of foil 38, 40. The sheets 38, 40 are unwound from supply rolls 42, 44.

The sheets 38, 40 are welded together by welding rollers 46, 48. The rollers 46, 48 form horizontal and vertical weld lines which define sealed, generally flat pouches. The pouches are aligned in ten columns. Thus, adjacent horizontal weld lines define a row of ten pouches. Each of the pouches contains one of the tablets 12.

The cutter 36 then cuts through certain of the weld lines and forms perforations through the other weld lines. The resulting packages 26 are generally flat and each contain several pouches. In particular, the cutter 36 separates the pouches into five columns, with each column having two pouches to a row. The cutter 36 also slices through every third horizontal weld line. Thus, each package 26 has three rows of pouches with two pouches within each row, for a total of six pouches per package 26.

Similar packaging systems are disclosed in U.S. Pat. Nos. 4,398,634 to McClosky; U.S. Pat. No. 3,405,502 to Badder; and U.S. Pat. No. 3,210,908 to Samberg. The disclosures of these patents are incorporated herein by reference.

The packages 26 fall from the cutter 36 onto a conveyor 50. As illustrated schematically in FIG. 4, the conveyor 50 conveys the packages 26 five abreast to a package handling system 52. The package handling system 52 collates the packages 26 (i.e., counts the packages 26 and assembles the packages 26 into stacks 30) and positions the stacks 30 on the cartoner conveyor 22. At the end of the cartoner conveyor 22, the stacks 30 are sealed within cartons and removed from the conveyor 22.

As illustrated in FIG. 5, the cartoner conveyor 22 has two alternating sets of buckets, labeled "A" and "B". The system 52 loads stacks 30 into the buckets labeled "A". The system 52 does not load the buckets labeled "B".

A separate, second package handling system 54 (FIG. 4) loads stacks 30 into the buckets labeled "B". Packages 26 are supplied to the second package handling system 54 by a second packaging system (not illustrated) and a second conveyor 56. The second packaging system, the conveyor 56 and the package handling system 54 are identical to the packaging system 24, the conveyor 50 and the package handling system 52.

At the end of the conveyor 50, the packages 26 drop into five pockets 58 (FIG. 5) and form five vertical stacks 30. The term vertical with reference to FIG. 5 means the direction perpendicular to the plane of the paper. The sides of the stacks 30 are supported by vertical walls of the pockets 58. The packages 26 are individually counted as they are conveyed toward the pockets 58. When the stacks 30 are fully formed (i.e., when a predetermined number of packages 26 have fallen into the pockets 58), a pusher device 60 pushes all five of the stacks 30 onto an indexing conveyor 62. The five stacks 30 are pushed onto the indexing conveyor 62 at the same time.

The indexing conveyor 62 is operated intermittently by a clutch/brake unit (not illustrated). The indexing conveyor 62 is stationary while the stacks 30 are being pushed out of the pockets 58 by the pusher device 60.

During each intermittent operation of the indexing conveyor 62, the stacks 30 are moved a distance equal to the centerline spacing of the stacks 30 times the number of pockets 58. For example, if the centers of the stacks 30 are 5 inches (12.5 cm) apart, then the indexing conveyor 62 is moved or indexed 25 inches (63.5 cm) during each intermittent operation. After a single operation of the conveyor 62, the five stacks 30 are positioned in front of an indexer pusher system 64.

The indexer pusher system 64 has five selectively actuatable pneumatic cylinders 66, 68, 70, 72 and 74 for pushing the stacks 30 onto a continuously moving conveyor 76 of a barrel loader 78. The cylinders 66-74 are actuated in two stages. First, the cylinders 66, 70 and 74 are simultaneously actuated. This causes three of the stacks 30 to be pushed onto the continuously moving conveyor 76. Then, after a timed delay (i.e., after the stacks 30 which were pushed by the cylinders 66, 70 and 74 have passed the cylinder 66), the cylinders 68 and 72 are simultaneously actuated, such that the two stacks 30 remaining on the indexing conveyor 62 are pushed onto the conveyor 76. By pushing the stacks 30 onto the conveyor 76 in two stages, the spacing between the stacks 30 is increased.

After all five of the stacks 30 have been transferred from the indexing conveyor 62 to the barrel loader conveyor 76, the indexing conveyor 62 is again operated. This causes five more stacks 30 (which have been pushed from the pockets 58 onto the indexing conveyor 62 by the pusher device 60) to be positioned in front of the indexer pusher system 64.

The barrel loader 78 has orbiting barrel loader pushers 80 for pushing the stacks 30 from the conveyor 76 to the cartoner conveyor 22. The barrel loader pushers 80 are connected to and are driven by a rotating central drive member 82. The pushers 80 orbit around the central member 82 when the member 82 is rotated.

The pushers 80 are slidable in a direction which is perpendicular to the conveyors 76 and 22 and each of the pushers 80 has an integral cam follower 84. As the pushers 80 orbit around the central drive member 82, the cam followers 84 follow a stationary cam 86, only a top portion of which is illustrated. In particular, as the pushers 80 orbit over the member 82, the cam followers 84 cooperate with the top portion of the stationary cam 86 so as to cause the pushers 80 to be successively moved toward the continuously moving cartoner conveyor 22. As the pushers 80 orbit under the central member 82, a bottom portion (not illustrated) of the stationary cam 86 moves the pushers 80 away from the conveyor 22 and behind the conveyor 76.

The barrel loader conveyor 76 and the central member 82 are driven directly from the cartoner conveyor 22 by means illustrated schematically at 88 and 90. This way, the cartoner conveyor 22, the barrel loader conveyer 76 and the orbiting pushers 80 operate in synchronization. The conveyor 22, the conveyor 76 and the pushers 80 all move at the same linear velocity at the point where the stacks 30 are transferred onto the conveyor 22.

Only two pushers 80 are shown in the drawings but there are actually many such pushers 80 equiangularly spaced about the central drive member 82. Since the barrel loader 78 only loads the buckets labeled "A" (the other handling system 54 loads the buckets labeled "B"), the pitch of the pushers 80 is equal to the pitch of the buckets labeled "A".

If the cartoner conveyor 22 is stopped for any reason, the indexer pusher system 64 is deactivated or disabled. When the indexer pusher system 64 is deactivated or disabled and the indexing conveyor 62 is operated, stacks 30 move past the indexer pusher system 64 and are deposited into an abort container 92.

FIGS. 6–10 illustrate another system which is constructed in accordance with the principles of the present invention. The system illustrated in FIGS. 6–10 includes a system 94 for collating (i.e., counting and assembling packages 26 into stacks 30) and for positioning the stacks 30 on a cartoner conveyor 22. Like the systems 52 and 54 illustrated in FIG. 4, the system 94 is designed to be used in pairs to supply alternate buckets of the cartoner conveyor 22 with stacks 30 of packages 26 from a pair of packaging systems.

The system 94 illustrated in FIGS. 6–10 is specially designed for high speed operation. For example, two of the systems 94 can collate and transfer packages 26 which are formed by a pair of Siebler foilers, each of which packages 2300 tablets per minute.

Figure 6:
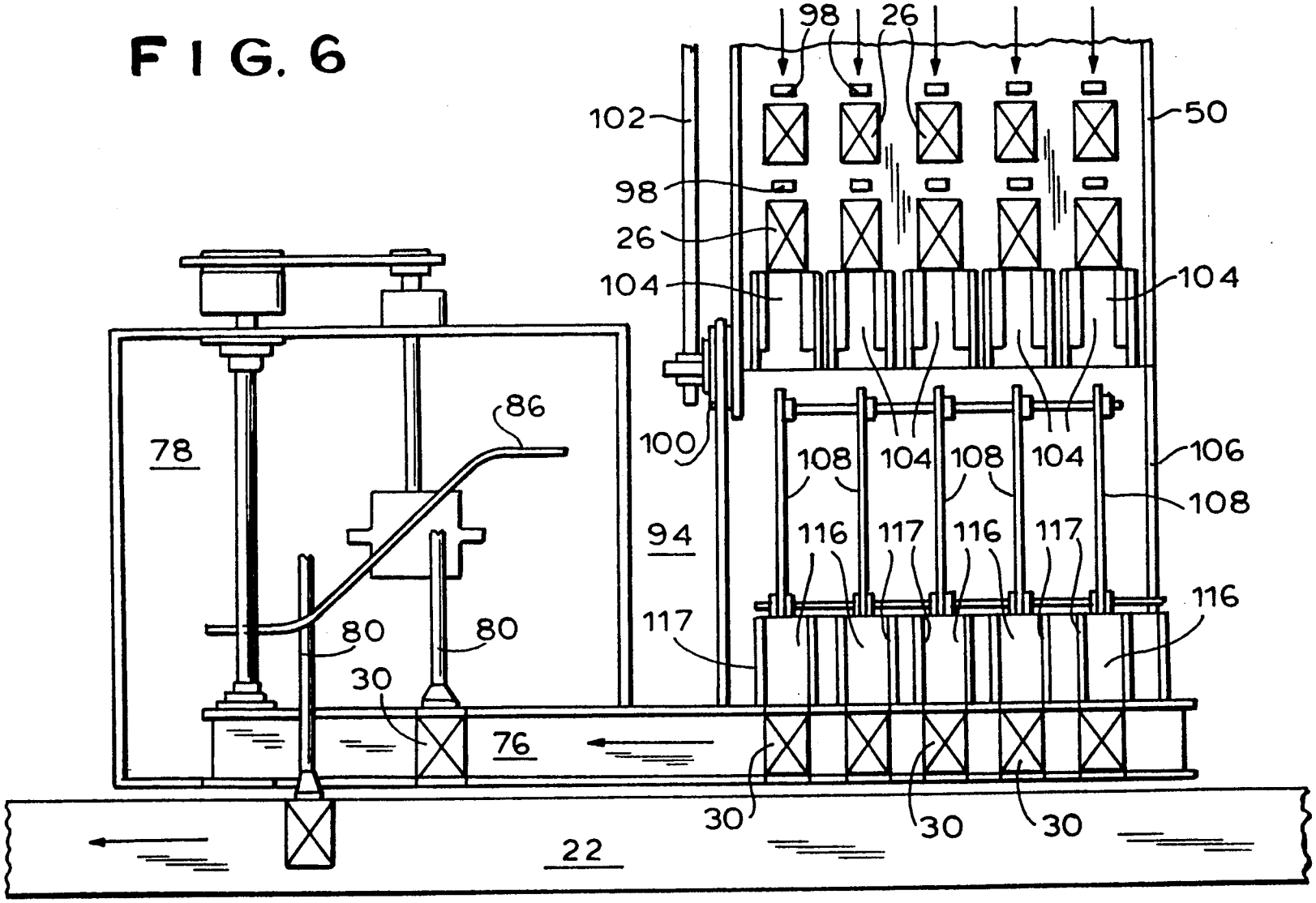
FIG. 6 is a top view of another package handling system in accordance with the present invention.

As best seen in FIG. 6, packages 26 are supplied to the system 94 by a conveyor 50 which has five slightly diverging pathways. As in the system illustrated in FIG. 5, the packages 26 are conveyed along the conveyor 50 five abreast. The packages 26 are pushed toward the end 96 of the conveyor 50 by separate sets of lugs 98, with five lugs 98 to each set. A drive sprocket 100 for driving the lugs 98 at the end 96 of the conveyor 50 is mechanically connected to a packaging system 24 by a drive shaft 102. This is an uncomplicated arrangement which ensures that five lugs 98 are in place to receive each row of packages 26 which falls onto the conveyor 50 from the cutter 36.

The lugs 98 move toward the end 96 of the conveyor 50, then around the end 96 and then back toward the packaging system 24. At the end 96 of the conveyor 50, the lugs 98 pass through openings 104 which are narrower than the flat packages 26. The packages 26 travel over the openings 104 and onto a platform 106.

Figure 7:
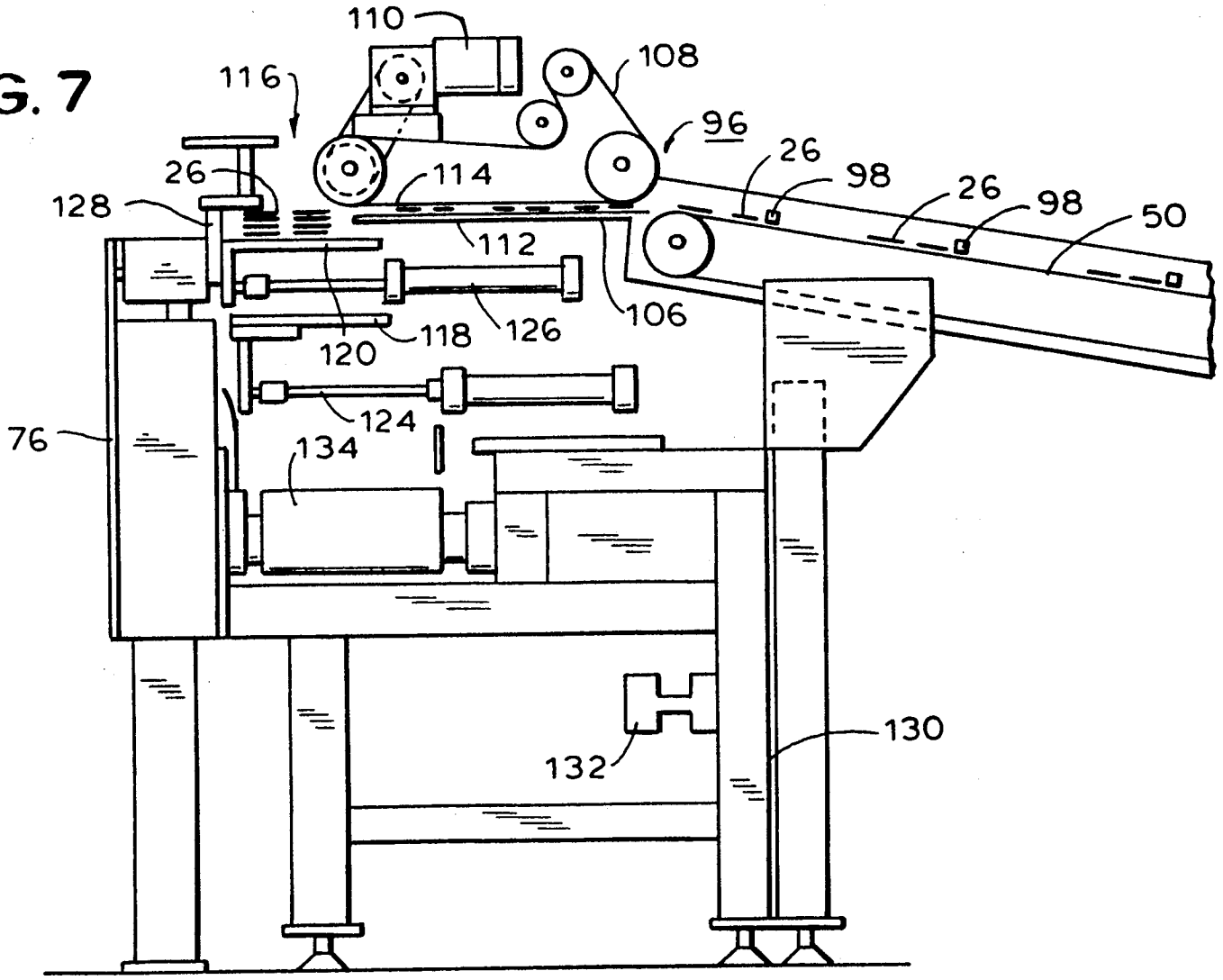
FIGS. 7-10 are side views of the package handling system of FIG. 6, in different stages of operation.

Each package 26 is frictionally engaged by and conveyed away from the end 96 of the conveyor 50 by an O-ring belt 108 which passes over the platform 106. Each O-ring belt 108 is driven by a motor 110 (FIG. 7). The O-ring belts 108 increase the speed of the packages 26. This is important because it moves the packages 26 away from the lugs 98 as the lugs 98 are moved around the end 96 of the conveyor 50 and through the openings 104.

The packages 26 pass under respective photoelectric counters 112 (only one of which is shown in the drawings) as they are conveyed across the platform 106. The packages 26 are counted by the counters 112, and then further conveyed by the 0-ring belts 108 over a front edge 114 of the platform 106 and into pockets 116. The packages 26 begin to form the stacks 30 as they fall into the pockets 116. As in the embodiment illustrated in FIG. 5, the sides of the stacks 30 are supported by vertical walls 117 (FIG. 6) of the pockets 116.

Figure 8:
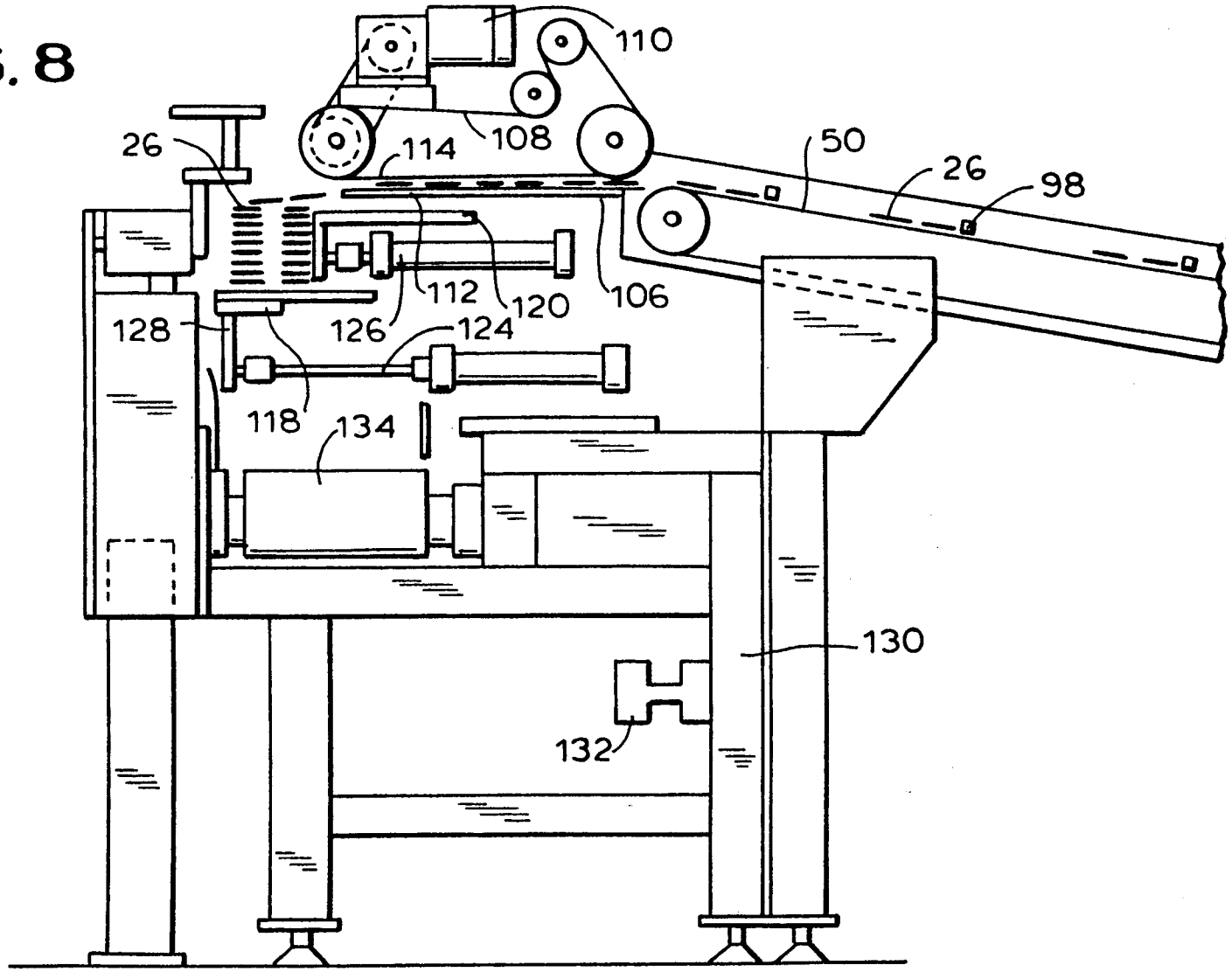
Figure 9:
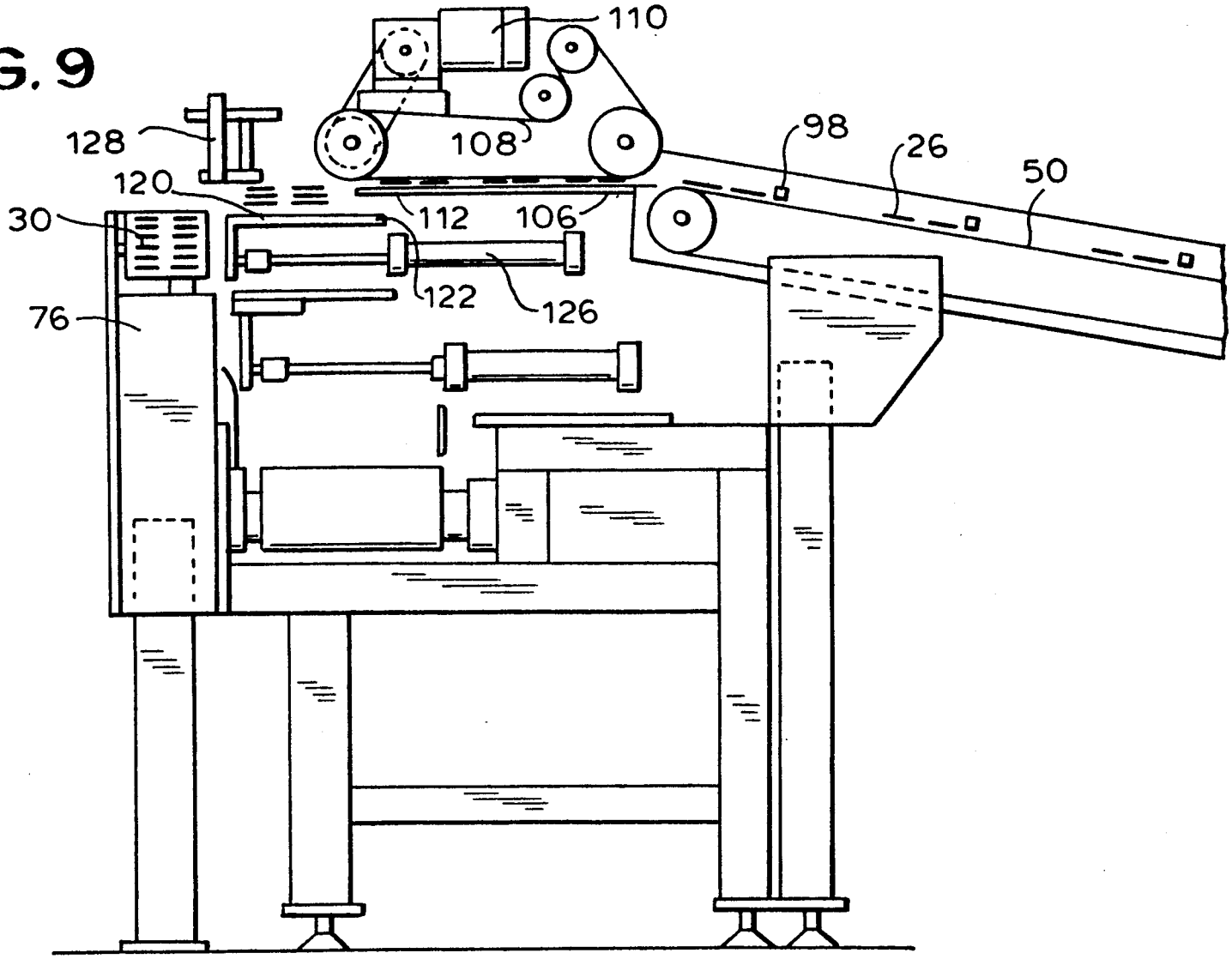
Figure 10:
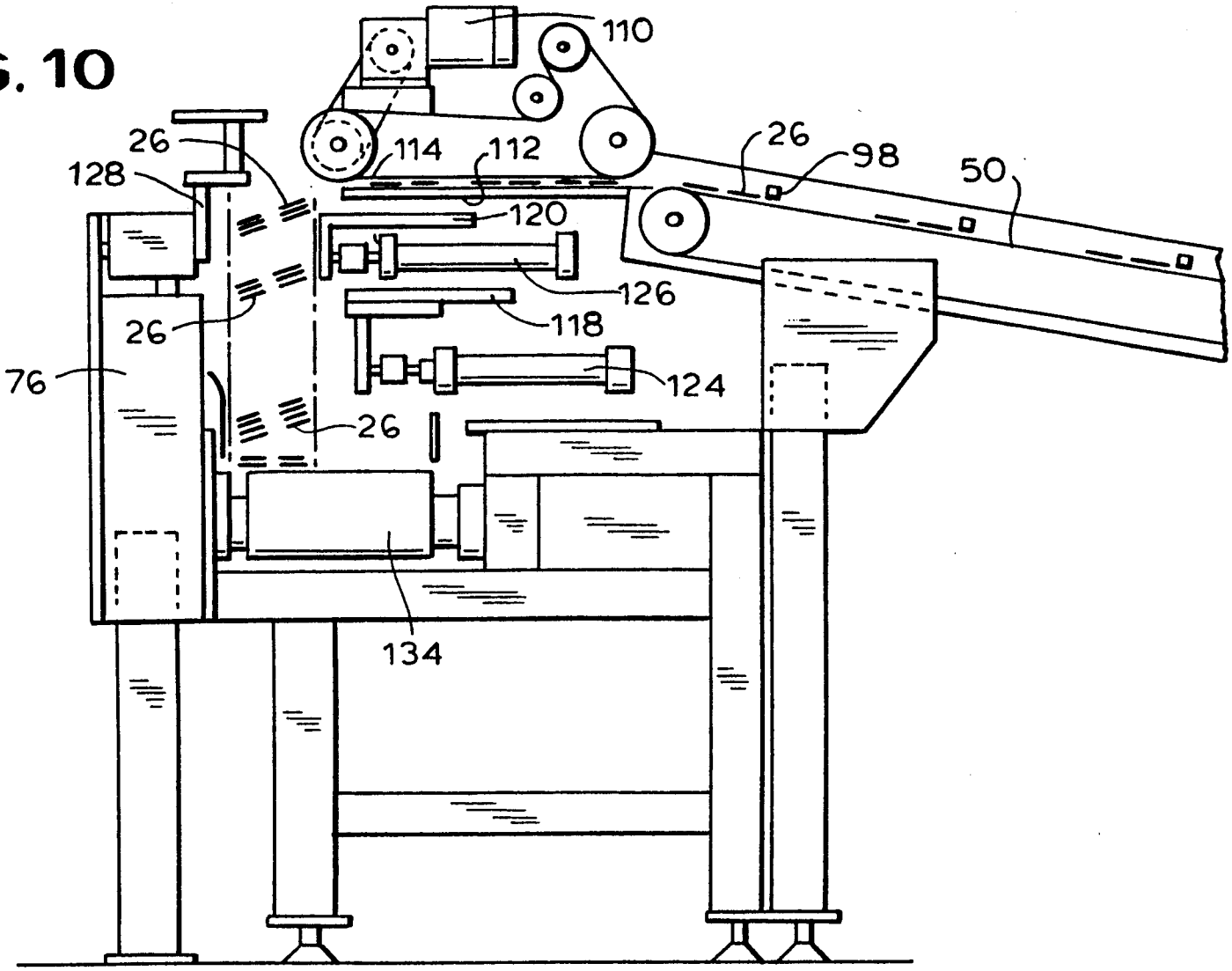

Each of the pockets 116 includes an abort plate 118, a pusher plate 120 and a collator gate 122 (FIG. 9). The abort plate 118 is moved between an extended position (FIGS. 7–9) and a retracted position (FIG. 10) by a pneumatic cylinder 124. The pusher plate 120 is moved between an extended position (FIGS. 7 and 9) and a retracted position (FIGS. 8 and 10) by a pneumatic cylinder 126. The collator gate 122 is movable between a first position (FIG. 9) and a second position (FIGS. 7, 8 and 10).

In its extended position (FIG. 7), the pusher plate 120 receives and supports packages 26 as they fall from the front edge 114 of the platform 106. The packages 26 begin to form a stack 30 on the pusher plate 120. But a stack 30 is not fully formed on the pusher plate 120. When a predetermined number of packages 26 has been counted by the counter 112, the pusher plate 120 is moved to its retracted position (FIG. 8), permitting the partially formed stack and subsequent packages 26 to fall onto the abort plate 118. The purpose of forming a partial stack on the pusher plate 120 is to limit the free-fall height of individual packages 26. The flat 2×3 packages 26 would tend to turn sideways if they were allowed to fall individually through the entire height of the pocket 116 (i.e., all the way from the edge 114 of the platform 106 to the abort plate 118).

The number of packages 26 to be supported on the pusher plate 120 before the pusher plate 120 is retracted is controlled by the counter 112 and a logic controller (not illustrated). Ideally, 50% to 80% of a stack 30 is formed on each pusher plate 120. The number of packages 26 which are to form the partial stack can be changed at any time, without stopping, by a keystroke on the logic controller.

When the desired number of packages 26 has been counted (i.e., when a stack 30 is fully formed on the abort plate 118), the collator gate 122 is moved to its first position (FIG. 9), thereby separating the fully formed stack 30 from subsequent packages 26. The pusher plate 120 is then returned to its extended position, thereby pushing the stack 30 out of the pocket 116 and onto a barrel loader conveyor 76.

A pencil cylinder rod 128 is mounted in front of each pocket 116. Whenever packages 26 are being fed into the pockets 116 by the O-ring belts 108, the pencil cylinder rods 128 are extended, as illustrated in FIGS. 7, 8 and 10. The rods 128 form front restraints or obstructions for the packages 26. That is, the rods 128 guide packages 26 into the pockets 116, preventing the packages 26 from traveling beyond the front of the pockets 116. The pencil cylinder rods 128 are retracted when the collator gate 122 is moved to its first position, as illustrated in FIG. 9. This way, the rods 128 do not prevent the stacks 30 from being pushed out of the pockets 116 by the pusher plates 120. After the stacks 30 have been transferred out of the pockets 116, the pencil cylinder rods 128 are again extended to define the fronts of the pockets 116 and the collator gates 122 are again returned to their second positions, thereby permitting packages 26 to fall onto the pusher plates 120, as illustrated in FIG. 7.

The high speed system illustrated in FIGS. 6–10 does not use an indexing conveyor. Rather, stacks 30 are transferred directly from the pockets 116 onto the barrel loader conveyor 76. In particular, the stacks 30 are transferred one by one onto the conveyor 76 by actuating the pneumatic cylinders 126 and thereby the pusher plates 120 in succession.

The successive operation of the pusher plates 120 is controlled by a bank 130 of five rotating cams. The cam bank 130 is driven directly from the cartoner conveyor 22 through a single revolution clutch 132. The five cams in the cam bank 130 are separated from each other by 360°/5=72°. The drive ratio between the barrel loader conveyor 76 and the cam bank 130 is as follows:

$$\frac{72}{360\,(Pbl - Pcol)/Pbl}$$

wherein:

Pbl=pitch of the buckets of the barrel loader 78

Pcol=pitch of the pusher plates 120

The single revolution clutch 132 is released when the stacks 30 are fully formed within the pockets 116 and when a photo sensor or proximity switch (not illustrated) determines that the barrel loader conveyor 76 is properly positioned. When the clutch 132 is released, the cam bank 130 is driven through one revolution. Every 72° of the revolution of the cam bank 130, a successive pusher plate 120 pushes a respective stack 30 onto the barrel loader conveyor 76.

The barrel loader 78 successively transfers the stacks 30 onto the cartoner conveyor 22. The barrel loader 78 illustrated in FIG. 6 operates the same as the barrel loader 78 of FIG. 5. As in the embodiment illustrated in FIGS. 4 and 5, the barrel loader 78 loads every other bucket of the cartoner conveyor 22. An identical barrel loader of an identical package handling system loads the alternate buckets of the conveyor 22.

When the cartoner conveyor 22 stops (for whatever reason), each collator gate 122 is moved to its second position and the pusher plates 120 and the abort plates 118 are moved to their retracted positions (FIG. 10). In this abort position, the packages 26 fall directly all the way down past the abort plates 118 and onto an abort conveyor 134. The abort conveyor 134 conveys the packages 26 to an abort container (not illustrated).

Although the present invention has been described in relation to particular embodiments thereof, many other variations and modifications and other uses will become apparent to those skilled in the art. For example, the system can easily be adapted for use in conjunction with powder instead of tablets. In this embodiment, the tablet press (not illustrated) can be replaced by a blender, and a hopper added to deliver the powder to the packaging system 24.

Similarly, the packaging system 24 can be adapted to produce various combinations of pouches per package. Hence, in addition to the package 26, described above, a package may contain one row with two pouches, or two rows with two pouches within each row, or four rows with two pouches within each row.

Furthermore, the system can also be adapted for use with one packaging system 24 and one handling system 28 instead of two packaging and handling systems described above.

It is preferred, therefore, that the present invention be limited not by the specific disclosure herein, but only by the appended claims.

What is claimed is:

1. A package handling system, comprising:

an abort plate which is movable between a first position and a second position, the abort plate being adapted to support a stack of packages when the abort plate is in its first position, the abort plate being adapted to permit packages to fall past the first position when the abort plate is in its second position;

a pusher plate which is movable between a first position and a second position, the pusher plate being adapted to support packages when the pusher plate is in its first position, the pusher plate being adapted to permit packages to fall onto the abort plate when the pusher plate is in its second position and the abort plate is in its first position, the pusher plate being adapted to push the stack of packages off the abort plate when the pusher plate is moved from its second position to its first position; and a gate which is movable between a first position and a second position, the gate being adapted to separate packages from the stack when the gate is in its first position, the gate being adapted to permit packages to fall onto the pusher plate when the gate is in its second position and the pusher plate is in its first position.

2. The package handling system of claim 1, further comprising an obstruction which is movable between a first position and a second position, the obstruction being adapted to guide packages onto the pusher plate when the gate is in its second position and the pusher plate is in its first position, the obstruction being adapted to guide packages onto the abort plate when the obstruction is in its second position, the gate is in its second position and the pusher plate is in its second position, the obstruction being adapted to permit the stack to be pushed off the abort plate by the pusher plate when the obstruction is in its first position.

3. The package handling system of claim 2, wherein the obstruction includes an extendable pencil cylinder rod.

4. The package handling system of claim 2, further comprising:

a conveyor for conveying packages to the first position of the gate;

a counter for counting packages conveyed to the first position of the gate; and control means for: (1) moving the gate to its second position; (2) then moving the pusher plate to its second position when the counter counts a first number of packages; and (3) then moving the pusher plate to its first position when the counter counts a second number of packages, the second number being greater than the first number.

5. The package handling system of claim 4, wherein the counter includes a photo sensor.

6. The package handling system of claim 4, wherein the control means includes pneumatic cylinders.

7. The package handling system of claim 4, further comprising an abort conveyor for conveying packages which fall past the first position of the abort plate.

* * * * *